US008766854B2

(12) United States Patent
Lin et al.

(10) Patent No.: US 8,766,854 B2
(45) Date of Patent: Jul. 1, 2014

(54) BOTTOM FEED CAVITY APERTURE ANTENNA

(75) Inventors: Shih-Kai Lin, Taipei (TW); Yi-Cheng Lin, Taipei (TW)

(73) Assignee: National Taiwan University, Taipei (TW)

( * ) Notice: Subject to any disclaimer, the term of this patent is extended or adjusted under 35 U.S.C. 154(b) by 527 days.

(21) Appl. No.: 12/684,057

(22) Filed: Jan. 7, 2010

(65) Prior Publication Data

US 2011/0163933 A1 Jul. 7, 2011

(51) Int. Cl.
*H01Q 1/38* (2006.01)
*H01Q 13/18* (2006.01)

(52) U.S. Cl.
USPC ..... 343/700 MS; 343/789; 343/833

(58) Field of Classification Search
USPC ..... 343/700 MS, 789, 846, 833, 834
See application file for complete search history.

(56) References Cited

U.S. PATENT DOCUMENTS

| | | | | | |
|---|---|---|---|---|---|
| 4,131,894 | A * | 12/1978 | Schiavone | ..... | 343/700 MS |
| 4,197,545 | A * | 4/1980 | Favaloro et al. | ..... | 343/700 MS |
| 5,010,348 | A * | 4/1991 | Rene et al. | ..... | 343/700 MS |
| 5,055,852 | A * | 10/1991 | Dusseux et al. | ..... | 343/725 |
| 5,233,364 | A * | 8/1993 | Lefeuvre et al. | ..... | 343/789 |
| 5,434,581 | A * | 7/1995 | Raguenet et al. | ..... | 343/700 MS |
| 5,453,754 | A * | 9/1995 | Fray | ..... | 343/789 |
| 5,539,420 | A * | 7/1996 | Dusseux et al. | ..... | 343/769 |
| 6,731,243 | B2 * | 5/2004 | Taira et al. | ..... | 343/700 MS |
| 6,756,942 | B2 * | 6/2004 | Heyde | ..... | 343/700 MS |
| 7,053,835 | B2 * | 5/2006 | Noro et al. | ..... | 343/700 MS |
| 7,187,328 | B2 * | 3/2007 | Tanaka et al. | ..... | 343/700 MS |
| 8,174,450 | B2 * | 5/2012 | Tatarnikov et al. | .... | 343/700 MS |

* cited by examiner

*Primary Examiner* — Michael C Wimer

(57) ABSTRACT

A bottom feed cavity aperture antenna is provided. The bottom feed cavity aperture antenna includes a patch and a ground structure. The patch feeds a signal to the bottom feed cavity aperture antenna. The ground structure includes a continuous wall, and a top end and a bottom end, wherein the continuous wall surrounds the patch, a thickness of the ground structure is formed between the top end and the bottom end, a patch height is formed between the patch and the bottom end, and a ratio of the patch height to the thickness is substantially lower than 1/2, and a magnetic field is formed at the top end, and magnetic resonance directions of the magnetic field are parallel to a first axis.

11 Claims, 7 Drawing Sheets

BOTTOM FEED CAVITY APERTURE ANTENNA

BACKGROUND OF THE INVENTION

1. Field of the Invention

The present invention relates to a bottom feed cavity aperture antenna, and in particular relates to a bottom feed cavity aperture antenna having increased bandwidth.

2. Description of the Related Art

FIG. 1 shows a conventional antenna 1, comprising a radiator 10, a ground element 20, and a capacitor feed 30. An aperture 40 is formed between the radiator 10 and the ground element 20. The capacitor feed 30 feeds signals to the radiator 10. Conventionally, the radiator 10 and a top end of the ground element 20 are located on a same plane. The conventional antenna 1 transmits wireless signals via an electric field generated thereby. However, conventional antennas cannot provide sufficient bandwidths.

BRIEF SUMMARY OF THE INVENTION

A detailed description is given in the following embodiments with reference to the accompanying drawings.

In one embodiment, a bottom feed cavity aperture antenna is provided. The bottom feed cavity aperture antenna comprises a patch and a ground structure. The patch feeds a signal to the bottom feed cavity aperture antenna. The ground structure comprises a continuous wall, and a top end and a bottom end, wherein the continuous wall surrounds the patch, a thickness of the ground structure is formed between the top end and the bottom end, a patch height is formed between the patch and the bottom end, and a ratio of the patch height to the thickness is substantially lower than 1/2. Also, a magnetic field is formed at the top end, and magnetic resonance directions of the magnetic field are parallel to a first axis.

In another embodiment, a bottom feed cavity aperture antenna is provided. The bottom feed cavity aperture antenna comprises a patch, a ground structure and a top sheet. The patch feeds a signal to the bottom feed cavity aperture antenna. The ground structure comprises a continuous wall, and a top end and a bottom end, wherein the continuous wall surrounds the patch. The top sheet is disposed on the continuous wall at the top end, wherein a magnetic field is formed at the top end, and magnetic resonance directions of the magnetic field are parallel to a first axis.

The bottom feed cavity aperture antenna of the embodiment of the invention can provide a wide bandwidth, a stable divergence field, and improved polarization purity.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
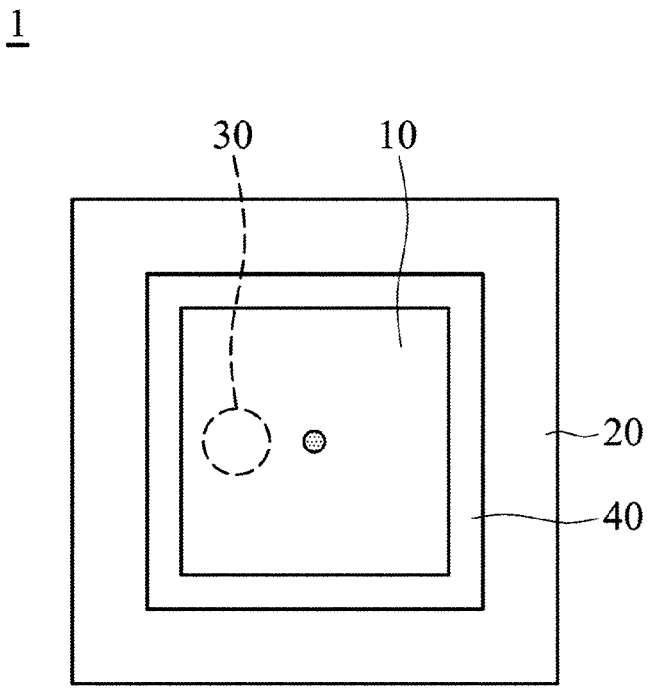
FIG. 1 ( PRIOR ART )
FIG. 1 shows a conventional aperture antenna.
Figure 2:
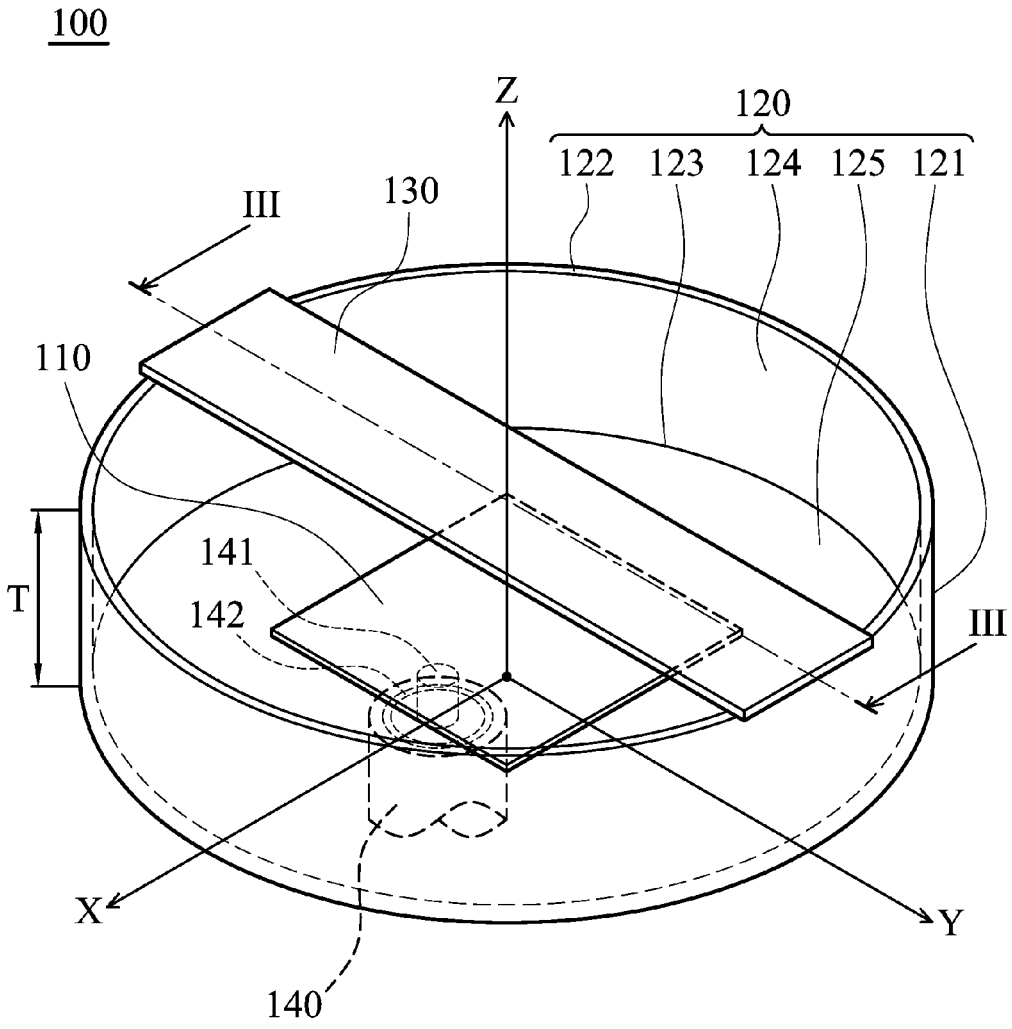
FIG. 2 shows a bottom feed cavity aperture antenna of an embodiment of the invention.

FIG. 2 shows a bottom feed cavity aperture antenna 100 of an embodiment of the invention, comprising a patch 110, a ground structure 120, and a top sheet 130. The patch 110 feeds a signal to the bottom feed cavity aperture antenna 100. The ground structure 120 comprises a continuous wall 121, a top end 122 and a bottom end 123. An opening 124 is formed on the top end 122 by the continuous wall 121. The continuous wall 121 surrounds the patch 110. The top sheet 130 is disposed on the continuous wall 121 at the top end 122.

Figure 3:
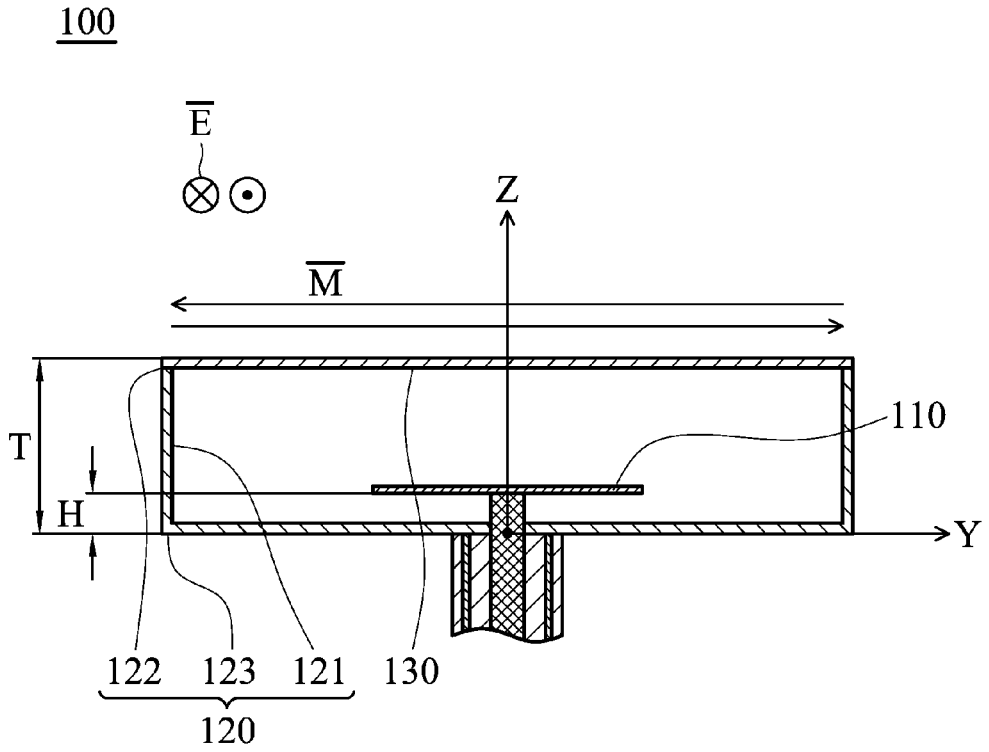
FIG. 3 is a sectional view along direction III-III of FIG. 2.
Figure 4:
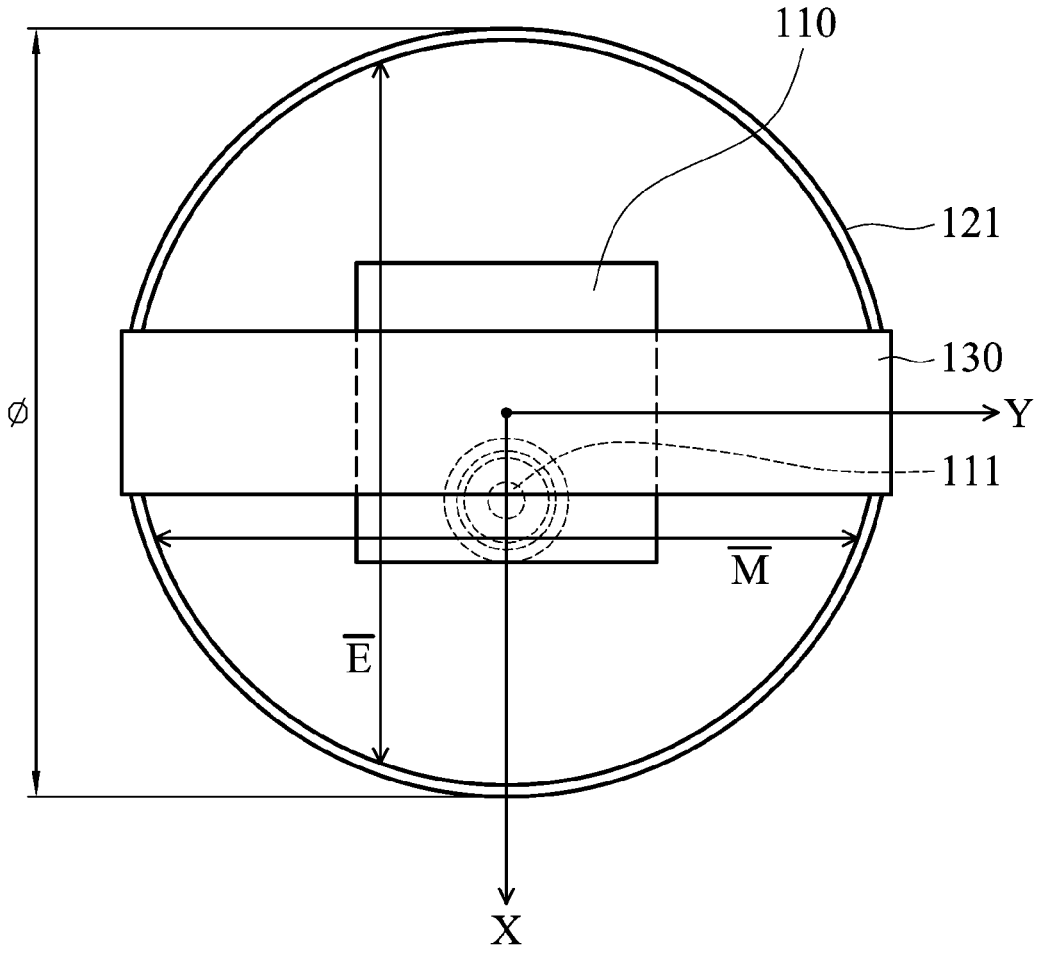
FIG. 4 is a top view of the bottom feed cavity aperture antenna of FIG. 2.

FIG. 3 is a sectional view along direction III-III of FIG. 2, and a thickness T of the ground structure 120 is formed between the top end 122 and the bottom end 123. A patch height H is formed between the patch 110 and the bottom end 123, and a ratio of the patch height H to the thickness T is substantially lower than 1/2, and a magnetic field $\overline{M}$ is formed at the top end 122, and magnetic resonance directions of the magnetic field $\overline{M}$ are parallel to a first axis Y. With reference to FIG. 4, which is a top view of the bottom feed cavity aperture antenna 100, an electric field $\overline{E}$ is formed at the top end 122, and electric resonance directions of the electric field $\overline{E}$ are parallel to a second axis X, and the first axis Y is perpendicular to the second axis X.

With reference to FIG. 2, the ground structure 120 further comprises a bottom portion 125, and the continuous wall 121 is connected to the bottom portion 125 at the bottom end 123 and is perpendicular thereto. The ground structure 120 is a bucket shaped structure. In this embodiment, a cable line 140 is provided. The cable line 140 comprises a signal line 141 and a ground line 142. The signal line 141 is electrically connected to the patch 110 at a feed point 111. The ground line 142 is electrically connected to the ground structure 120. The patch 110 comprises a bottom surface, the bottom surface faces the bottom portion 125, and the feed point 111 is on the bottom surface. In this embodiment, the current signal is fed to the patch 110 by the signal line 141; however, the invention is not limited thereto. In a modified embodiment, the current signal can be fed to the patch 110 by coupling or other ways. As well, the feed point 111 can be located on the continuous wall.

With reference to FIG. 4, the patch 110 is rectangular. The patch 110 can also be other shapes. The feed point 111 is located on the second axis X, and near a side of the patch 110. A location of the feed point 111 can be moved to modify impedance and matching performance. The continuous wall 121 defines a radiation area, the radiation area is circular, and the radiation area has a diameter $\phi$. The top sheet 130 is rectangular. The top sheet 130 has a major axis, and the major axis is parallel to the first axis Y. In a modified example, the radiation area can also be rectangular or other shapes.

Figure 5A:
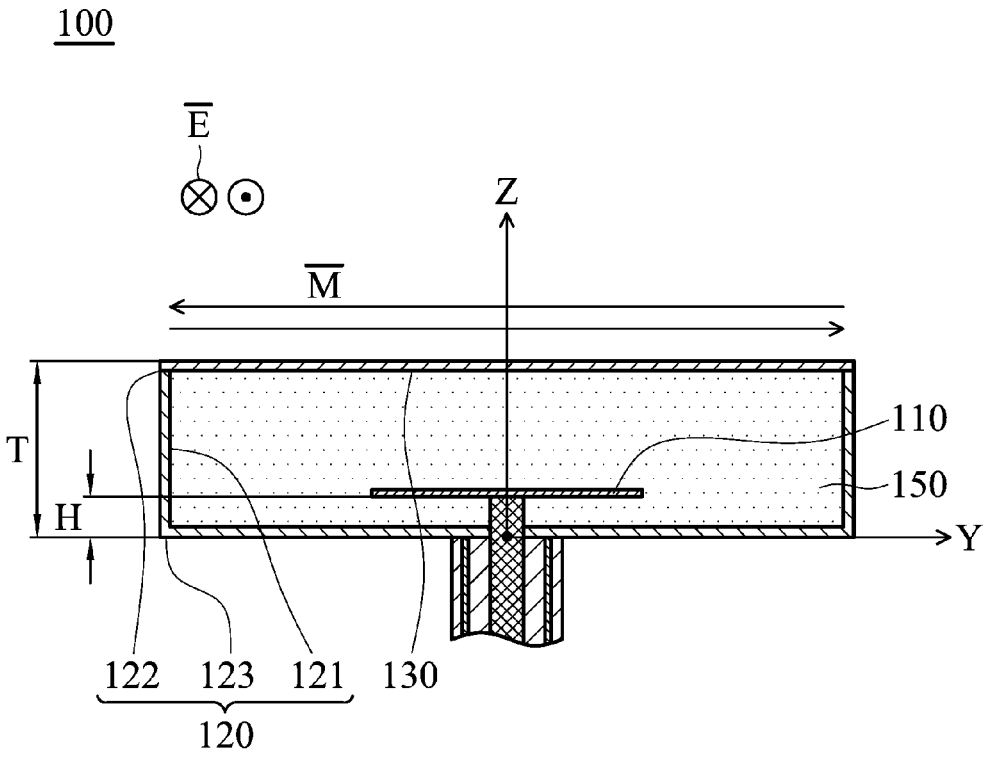
FIG. 5*a* shows a modified example of the invention, wherein a continuous wall defines a radiation area, and a dielectric material is filled in the radiation area.
Figure 5B:
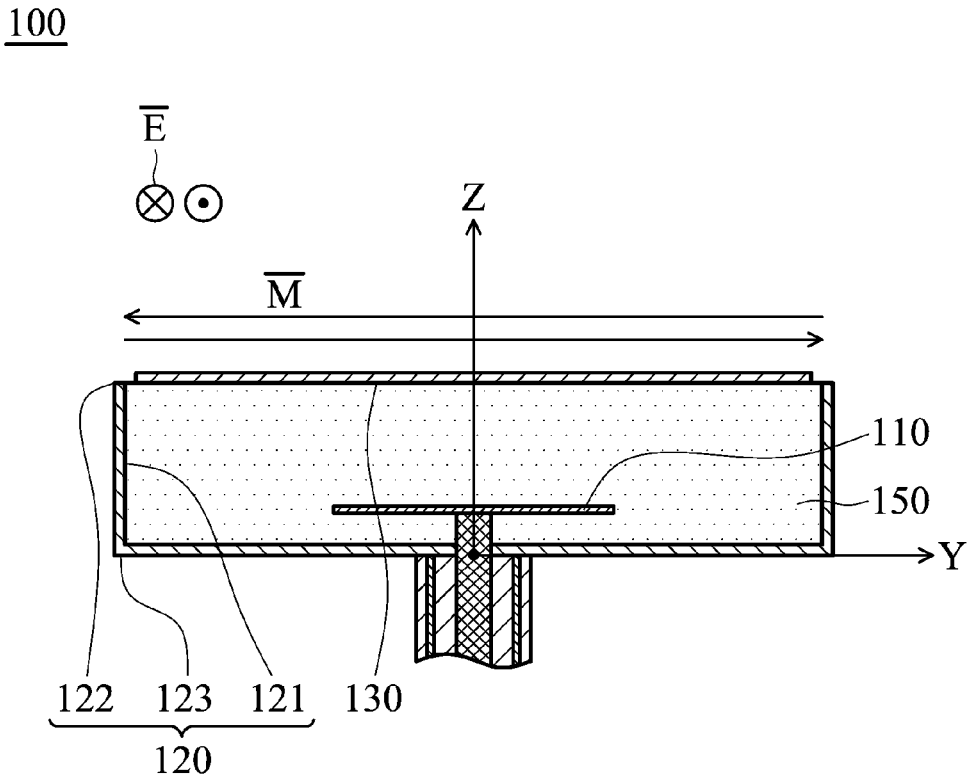
FIG. 5*b* shows another modified example of the invention.

In one embodiment, the thickness T of the ground structure is about $\lambda$ g/4, wherein $\lambda$ g is a wave length of an operation frequency. The patch height H can be lower than $\lambda$ g/8, for example, $\lambda$ g/10 or $\lambda$ g/25. The patch height H may be between $\lambda$ g/8 to $\lambda$ g/10, $\lambda$ g/10 to $\lambda$ g/25 or lower than $\lambda$ g/25. A longest distance between two points on the edge of the radiation area is about 0.7 λ g. For example, when the radiation area is circular, a diameter thereof is about 0.7 λ g. Additionally, with reference to FIG. 5*a*, in one embodiment, the continuous wall 121 defines a radiation area, a dielectric material 150 is filled in the radiation area, and the patch 110 is embedded in the dielectric material 150. With reference to FIG. 5*b*, in another embodiment, the top sheet 130 is separated from the top end 122, and disposed on the dielectric material 150. The position of the top sheet 130 on the second axis X and a third axis Z can be adjusted to modify impedance matching and gain patterns.

In the embodiment, the diameter ϕ and the thickness T can be modified to control operation frequency.

The bottom feed cavity aperture antenna of the embodiment of the invention can provided a wide bandwidth, a stable divergence field, and improved polarization purity.

Figure 6:
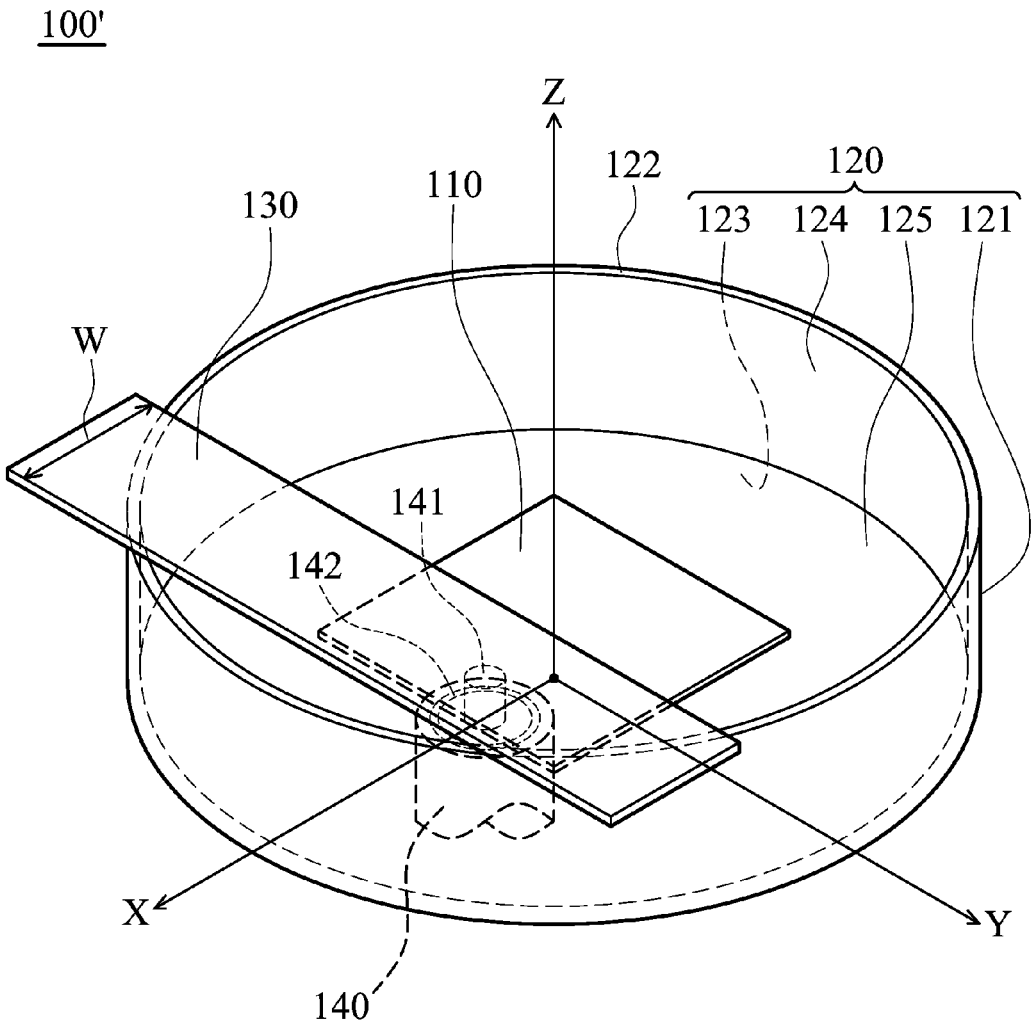
FIG. 6 shows a modified example of the invention, wherein a position of the top sheet can be moved along a second axis X.

FIG. 6 shows a modified example of the invention, wherein the position of the top sheet 130 can be moved along the second axis X. As well, the width W of the top sheet 130 can also be changed to modify gain patterns and bandwidths of the bottom feed cavity aperture antenna. The shape of the top sheet can also be modified.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A bottom feed cavity aperture antenna, comprising:

a patch, feeding a signal to the bottom feed cavity aperture antenna;

a ground structure, comprising a continuous wall, and a top end and a bottom end, wherein the continuous wall surrounds the patch and defines a radiation area, a structural thickness of the ground structure is formed between the top end and the bottom end, a patch height is formed between the patch and the bottom end, and a ratio of the patch height to the structural thickness is substantially lower than 1/2, and a magnetic field is formed at the top end, and magnetic resonance directions of the magnetic field are parallel to a first axis, wherein the ground structure defines an aperture; and a top sheet arranged to define impedance matching and gain patterns of the bottom feed cavity aperture antenna, wherein the top sheet merely partially covers the aperture, wherein the top sheet is rectangular, wherein the top sheet has a major axis and a minor axis, the major axis is longer than the minor axis, and the major axis is parallel to the first axis, and wherein two ends of the top sheet respectively contact a top edge of the ground structure;

wherein an electric field is formed at the top end, electric resonance directions of the electric field are parallel to a second axis, and the first axis is perpendicular to the second axis, and wherein the top sheet is metal, and the top sheet is electrically connected to the ground structure.

2. The bottom feed cavity aperture antenna as claimed in claim 1, further comprising:

a signal line, electrically connected to the patch at a feed point; and a ground line, electrically connected to the ground structure.

3. The bottom feed cavity aperture antenna as claimed in claim 2, wherein the patch is rectangular.

4. The bottom feed cavity aperture antenna as claimed in claim 3, wherein the feed point is located on the second axis, and near a side of the patch.

5. The bottom feed cavity aperture antenna as claimed in claim 3, wherein the radiation area is circular.

6. The bottom feed cavity aperture antenna as claimed in claim 2, wherein the ground structure further comprises a bottom portion, the continuous wall is connected to the bottom portion at the bottom end and is perpendicular thereto, and the ground line is connected to the bottom portion.

7. The bottom feed cavity aperture antenna as claimed in claim 6, wherein the patch comprises a bottom surface, the bottom surface faces the bottom portion, and the feed point is on the bottom surface.

8. The bottom feed cavity aperture antenna as claimed in claim 1, wherein the structural thickness of the ground structure is about $\lambda_g/4$, wherein $\lambda_g$ is a wave length of an operation frequency.

9. The bottom feed cavity aperture antenna as claimed in claim 1, wherein a dielectric material is filled in the radiation area.

10. The bottom feed cavity aperture antenna as claimed in claim 1, wherein the patch height is about $\lambda_g/10$, wherein $\lambda_g$ is a wave length of an operation frequency.

11. The bottom feed cavity aperture antenna as claimed in claim 1, wherein the patch height is about $\lambda_g/25$, wherein $\lambda_g$ is a wave length of an operation frequency.

* * * * *